US012144437B2

(12) United States Patent
Liu

(10) Patent No.: US 12,144,437 B2
(45) Date of Patent: Nov. 19, 2024

(54) ROCKING CHAIR FOR CHILDREN

(71) Applicant: ZHONGSHAN CITY TONGYIN BABY CO., LTD., Guangdong (CN)

(72) Inventor: Weibing Liu, Guangdong (CN)

(73) Assignee: ZHONGSHAN CITY TONGYIN BABY CO., LTD., Zhongshan (CN)

( * ) Notice: Subject to any disclaimer, the term of this patent is extended or adjusted under 35 U.S.C. 154(b) by 420 days.

(21) Appl. No.: 17/715,948

(22) Filed: Apr. 7, 2022

(65) Prior Publication Data

US 2022/0225789 A1 Jul. 21, 2022

Related U.S. Application Data

(63) Continuation of application No. PCT/CN2020/126950, filed on Nov. 6, 2020.

(30) Foreign Application Priority Data

May 18, 2020 (CN) ..... 202010421405.8

(51) Int. Cl.

| | |
|---|---|
| ***A47D 13/10*** | (2006.01) |
| ***A47C 3/025*** | (2006.01) |
| ***A47D 9/02*** | (2006.01) |
| *A63G 9/16* | (2006.01) |

(52) U.S. Cl.

CPC ..... *A47D 13/105* (2013.01); *A47C 3/0251* (2018.08); *A47D 9/057* (2022.08)

(58) Field of Classification Search

CPC . A63G 9/00; A63G 9/16; A63G 13/00; A63G 13/06; A47D 13/105; A47D 9/057; A47C 3/0251

USPC ..... 472/119

See application file for complete search history.

(56) References Cited

U.S. PATENT DOCUMENTS 6,068,566 A * 5/2000 Kim ..... A47D 9/057 474/84

FOREIGN PATENT DOCUMENTS

CN 111134487 A 5/2020

OTHER PUBLICATIONS

International Search Report of PCT Patent Application No. PCT/CN2020/126950 issued on Feb. 20, 2021.

* cited by examiner

*Primary Examiner* — Kien T Nguyen

(57) ABSTRACT

Disclosed is a rocking chair for children, the rocking chair comprising a seat body (1), a supporting frame (2), a seat body limiting mechanism (3), a driving electric motor (5), a driving electric motor power output portion (6), and a rotating shaft (7). One end of the rotating shaft (7) is fixedly connected to the driving electric motor power output portion (6); the seat body (1) pivots around the other end of the rotating shaft (7); when the rotating shaft (7) rotates, the pivot point between the other end of the rotating shaft (7) and the seat body (1) moves relative to the fixed connection point between one end of the rotating shaft (7) and the driving electric motor power output portion (6) at a certain distance.

17 Claims, 19 Drawing Sheets

ROCKING CHAIR FOR CHILDREN

CROSS REFERENCE TO RELATED APPLICATIONS

The present application is a Continuation Application of PCT Application No. PCT/CN2020/126950 filed on Nov. 6, 2020, which claims the benefit of Chinese Patent Application No. 202010421405.8 filed on May 18, 2020. All the above are hereby incorporated by reference in their entirety.

FIELD OF THE INVENTION

The invention relates to a rocking chair for children.

BACKGROUND OF THE INVENTION

For families with infants and young children, in order to take care of children and have time to work or do housework, the parents have the urgent need to place their children on rocking chairs for children. A rocking chair with a seat and a rotating shaft fixed is available in the market, the seat rotates along with the rotating shaft, but children are easy to feel dizzy and uncomfortable. A rocking chair with two Z-shaped rotating shafts is available in the market, and a seat body and the two rotating shafts are movably connected. Although the rotation angle of the seat body with the rotating shaft decreases, the seat body still rotates with the rotating shaft, which is not labor-saving, therefore, it is difficult to increase the rotation range, and the swing mode is single. At present, the products in the market are difficult to meet the needs of consumers. Nowadays, there is a need in the market for a rocking chair for children with simple structure and low cost, in which the seat body does not rotate with the rotating shaft, multiple rotation ranges are available, and two swing modes can be realized or conversion of at least two swing modes can be realized at the same time.

SUMMARY OF THE INVENTION

The invention is proposed in view of the above problems existing in the prior art. The purpose of the invention is to provide a rocking chair for children with simple structure and low cost, in which the seat body can swing and does not rotate with the rotating shaft, the swing range is large, and multiple swing ranges are available for the consumers, and two swing modes can be realized or conversion of at least two swing modes can be realized at the same time.

The invention is realized by the following technical solution:

A rocking chair for children includes a seat body, a supporting frame and a seat body limiting mechanism; the supporting frame includes a base and a driving mechanism, the driving mechanism includes a driving electric motor, a driving electric motor power output portion, a rotating shaft, and a mounting box, one end of the rotating shaft is fixedly connected with the driving electric motor power output portion, and the seat body pivots around the other end of the rotating shaft, when the rotating shaft rotates, a pivot point between the other end of the rotating shaft and the seat body moves relative to a fixed connection point between one end of the rotating shaft and the driving electric motor power output portion at a certain distance; the driving electric motor and the driving electric motor power output portion are arranged on the mounting box, the mounting box is fixedly connected with the base, and the seat body limiting mechanism includes a driving piece and a driving matching piece; and when the rotating shaft rotates, a matching point of the driving piece and the driving matching piece moves relative to the supporting frame at a certain distance, the seat body limiting mechanism limits the included angle between the seat body and the rotating shaft to be maintained at a set angle when the driving electric motor drives the rotating shaft; and the seat body is used for carrying a child.

Preferred solution: the seat body limiting mechanism includes a swing mode conversion portion, which can realize conversion of at least two swing modes when the rotating shaft rotates.

Further, the swing mode conversion portion includes a driving portion, and the driving portion drives the driving piece to match with the driving matching piece, and the generated matching point forms at least two different motion trajectory lines, so as to realize the conversion of at least two swing modes.

Further, the driving portion includes an electric driving portion, the driving piece rotates or moves relative to the driving matching piece at a certain distance, and the driving matching piece rotates or moves relative to the supporting frame at a certain distance, and when the rotating shaft rotates, the driving portion drives the driving matching piece to rotate or move relative to the supporting frame at a certain distance, so as to realize the conversion of at least two swing modes.

Further, the driving piece is a moving piece, the driving matching piece is a moving groove, and the moving groove is pivoted with the supporting frame; the electric driving portion includes a driving electric motor group which includes a motor, a rotating piece and an output piece, the motor is fixedly connected with the rotating piece, the rotating piece is pivoted with the output piece, and the output piece is pivoted with the moving groove, the rotating shaft rotates the driving electric motor group to enable the moving groove to continuously rotate back and forth relative to the supporting frame.

Further, the driving portion further includes a locking and unlocking piece, the driving piece moves relative to the driving matching piece at a certain distance, and the driving matching piece rotates or moves relative to the supporting frame at a certain distance; and after the driving matching piece and the supporting frame are unlocked and the driving matching piece rotates or moves relative to the supporting frame at a certain distance, the driving matching piece and the supporting frame are locked, and the driving matching piece cooperates with the driving piece to form another swing mode.

Further, the driving piece is a moving piece, the driving matching piece is a moving groove, the moving groove includes at least two moving grooves, the first moving groove and the second moving groove, notches of the first moving groove and the second moving groove do not coincide, and the moving groove moves up and down relative to the supporting frame.

Further, the driving piece is a moving piece, the driving matching piece is a moving groove, and the moving groove moves relative to the supporting frame along the swing direction of the rotating shaft.

Further, the moving piece is provided with a rotating piece, the moving piece pivots around the moving groove, the moving piece is provided with a first rotating piece and a second rotating piece, the first rotating piece is matched with the first moving groove, and the second rotating piece is matched with the second moving groove.

Preferred solution: the seat body limiting mechanism includes a moving piece, and a moving groove matched with the moving piece, when the rotating shaft rotates, the moving piece moves relative to the moving groove, the driving piece is a moving piece, and the driving matching piece is a moving groove.

Further, the moving piece includes at least two moving pieces, namely, a third moving piece and a fourth moving piece, the moving groove includes at least two moving grooves, namely, a third moving groove and a fourth moving groove, the third moving piece is matched with the third moving groove, and the fourth moving piece is matched with the fourth moving groove, one moving grooves is provided with a move-out opening groove for the corresponding moving piece to move out, the other moving groove is provided with a move-in opening groove for the corresponding moving piece to move in, the width of the move-out opening groove and the move-in opening groove is larger than the moving groove, and notches of the third moving groove and the fourth moving groove do not coincide.

Further, a stop is arranged on the moving groove, a rotating piece is arranged on the moving piece, and a bearing is pivoted on the rotating piece.

Further, the moving piece is arranged on the seat body, and the moving groove is arranged on the supporting frame.

Further, the moving groove is an arc groove or a wave-shaped groove with alternating heights.

Further, a rotating piece is arranged on the moving piece, the rotating piece is able to rotate around the moving piece, and the rotating piece is in surface fit with the moving groove.

Further, the driving mechanism further includes a sensor arranged on the driving electric motor, the sensor is able to control the electric motor to continuously rotate forwards and backwards in a reciprocating mode so that the rotating shaft is able to continuously rotate forwards and backwards in a reciprocating mode, and the rotating shaft is obliquely arranged.

Further, the rocking chair for children also includes a driving mounting box, the moving piece includes an upper end and a lower end, the upper end is fixedly connected or integrally formed with the lower end, the upper end is connected with the seat body after passing through the driving mounting box, the lower end is matched with the moving groove, and a connection point between the upper end and the seat body deviates from a matching point between the lower end and the moving groove.

Further, the mounting box is provided with a slotted hole sheet, the slotted hole sheet is movably arranged with the mounting box, and the slotted hole sheet is also provided with a slotted hole for the moving piece to move, and when the moving piece moves, the moving piece drives the slotted hole sheet to block the slotted hole.

BRIEF DESCRIPTION OF THE DRAWINGS

In order to more clearly explain the technical solution of the embodiment of the invention, the following will be briefly introduced in combination with the accompanying drawings. It is obvious that the accompanying drawings in the following description are only the specific embodiments of the invention, and for those skilled in the field, on the premise that creative labor is not paid, other drawings can be obtained according to the drawings.

DETAILED DESCRIPTION OF ILLUSTRATED EMBODIMENTS

Figure 1:
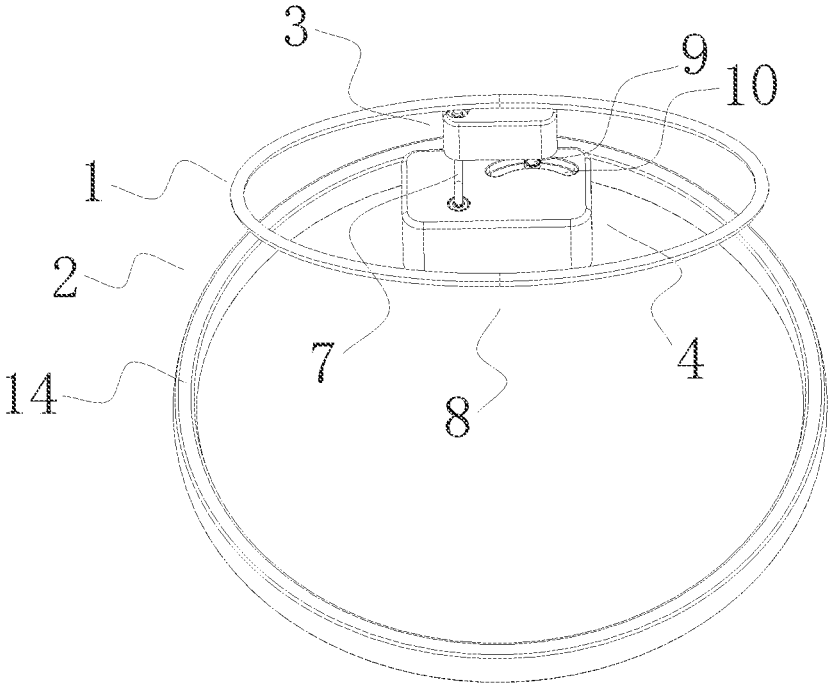
FIG. 1 is a structural diagram of a rocking chair for children.
Figure 2:
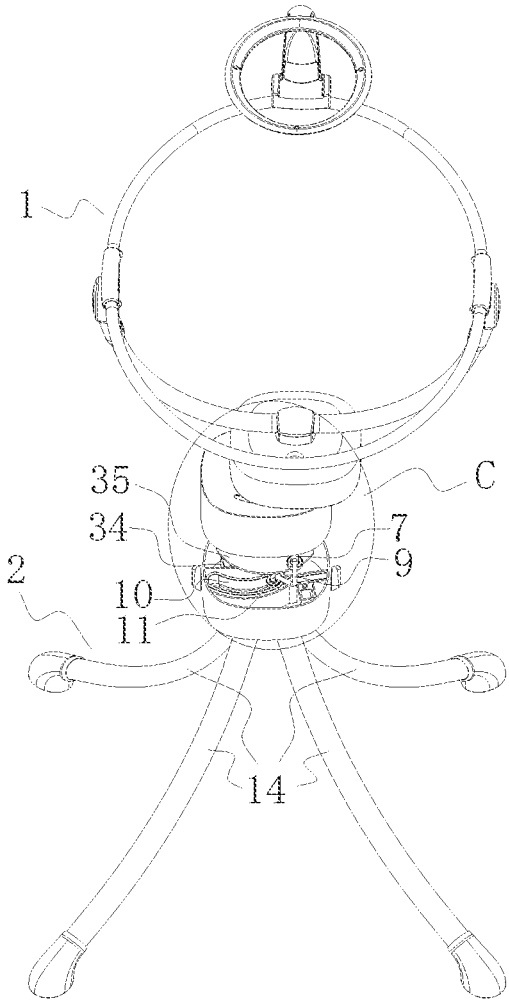
FIG. 2 is a structural diagram of a rocking chair for children with swing mode conversion.
Figure 3:
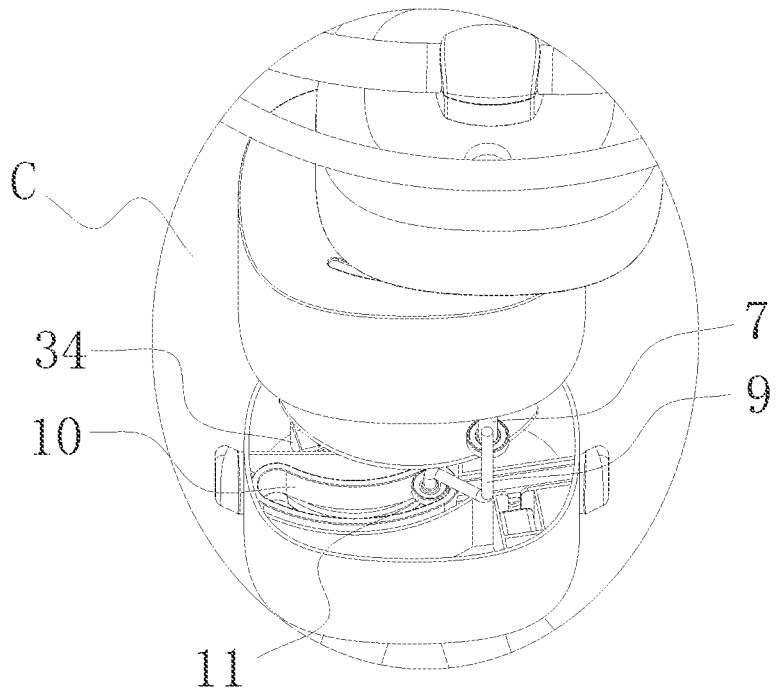
FIG. 3 is an enlarged schematic diagram at C of FIG. 2.
Figure 4:
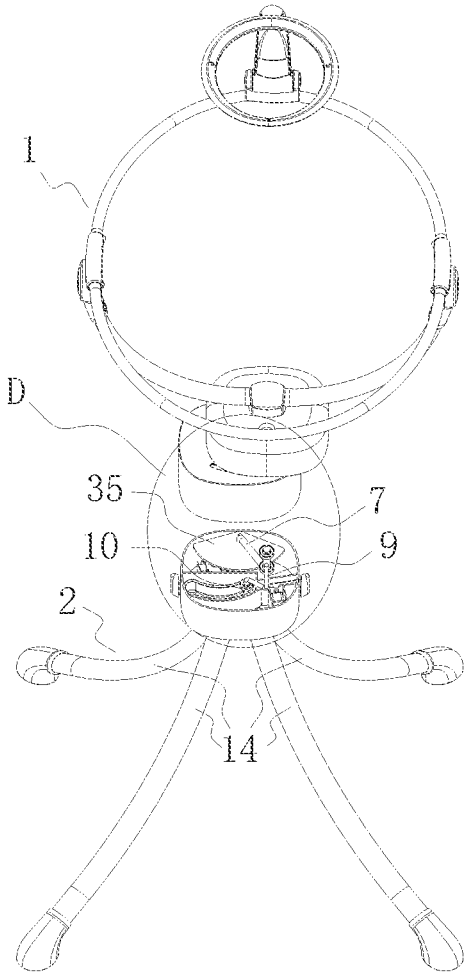
FIG. 4 is a structural diagram of a rocking chair for children after the swing mode conversion in FIG. 2.
Figure 5:
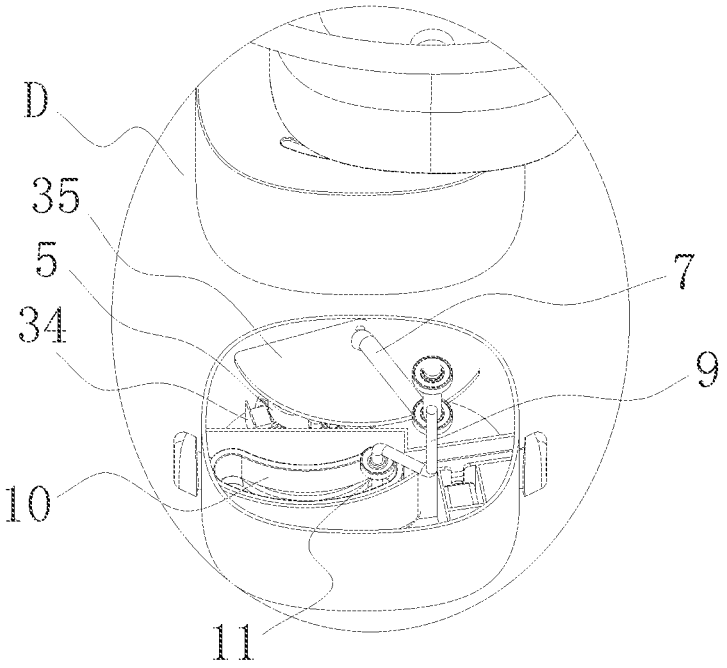
FIG. 5 is an enlarged schematic diagram at D of FIG. 4.
Figure 6:
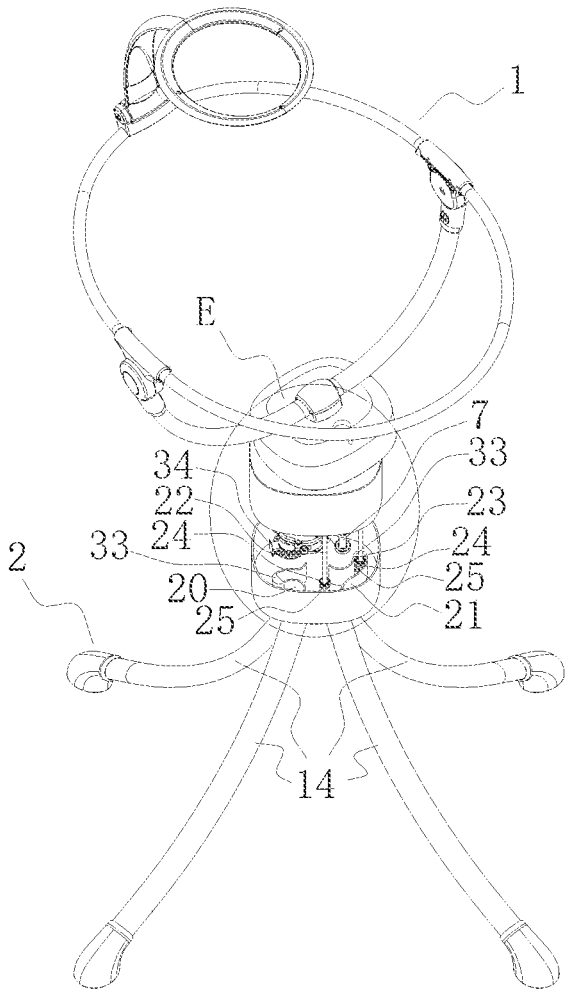
FIG. 6 is a structural diagram of a rocking chair for children with two moving grooves.
Figure 7:
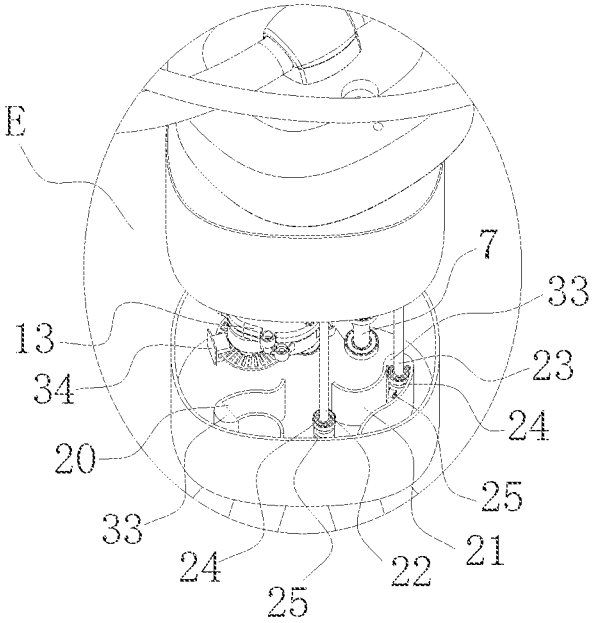
FIG. 7 is an enlarged schematic diagram at E of FIG. 6.
Figure 8:
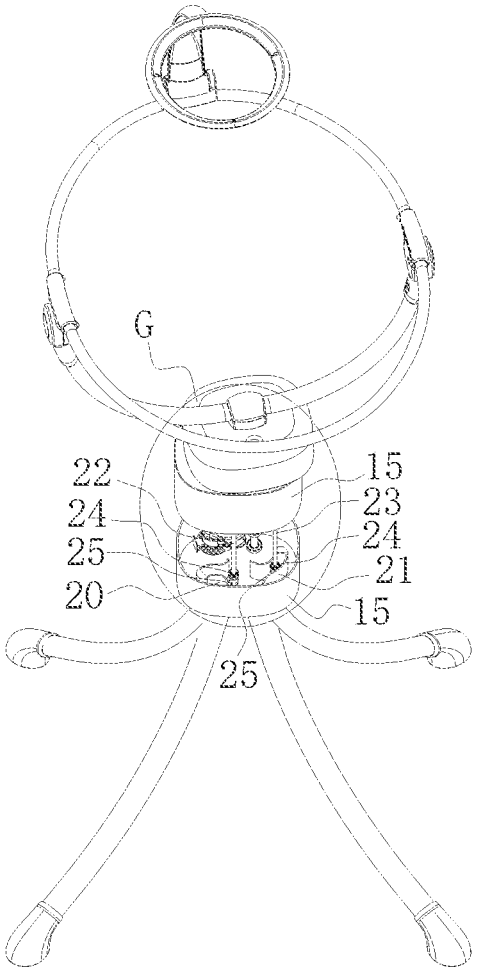
FIG. 8 is a structural diagram of a rocking chair for children after swinging in FIG. 6.
Figure 9:
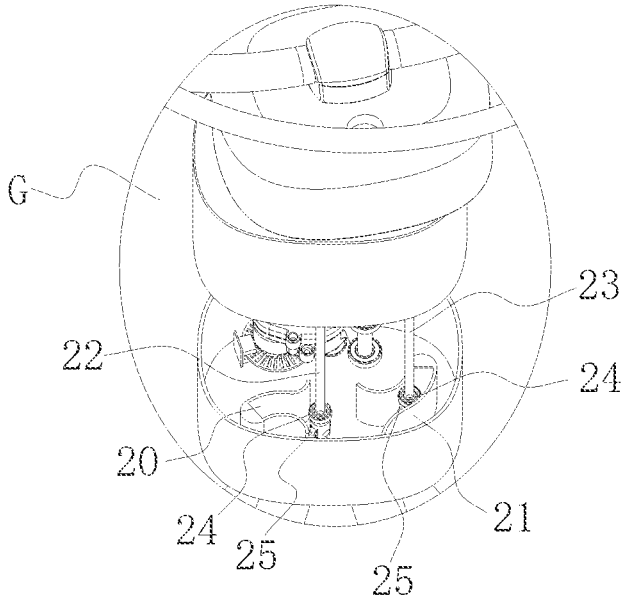
FIG. 9 is an enlarged schematic diagram at G of FIG. 8.
Figure 10:
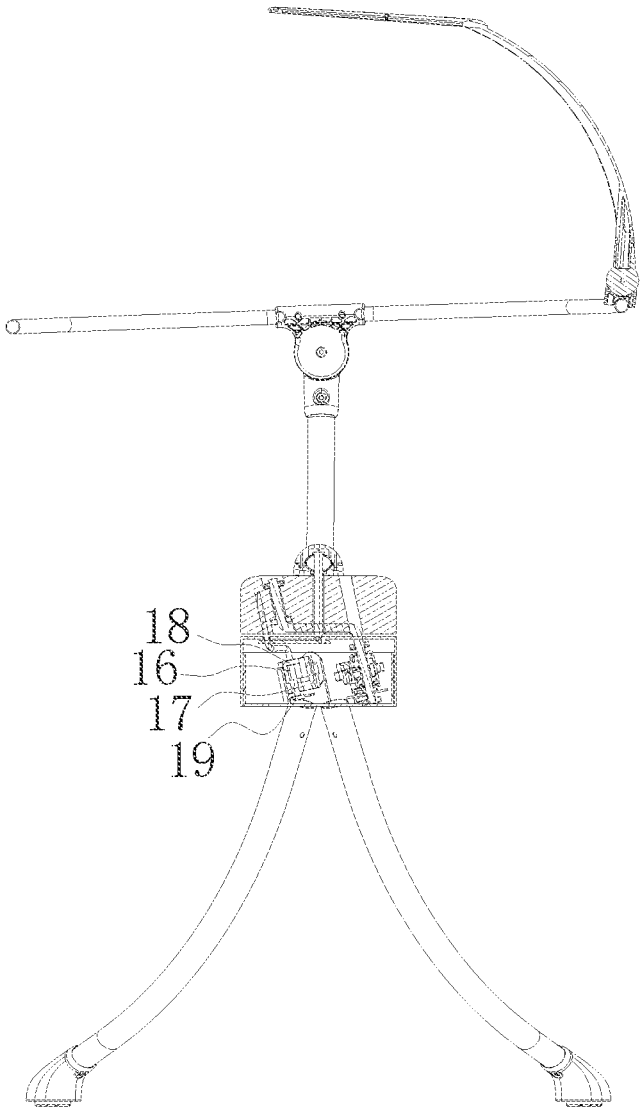
FIG. 10 is a sectional view of FIG. 2.
Figure 11:
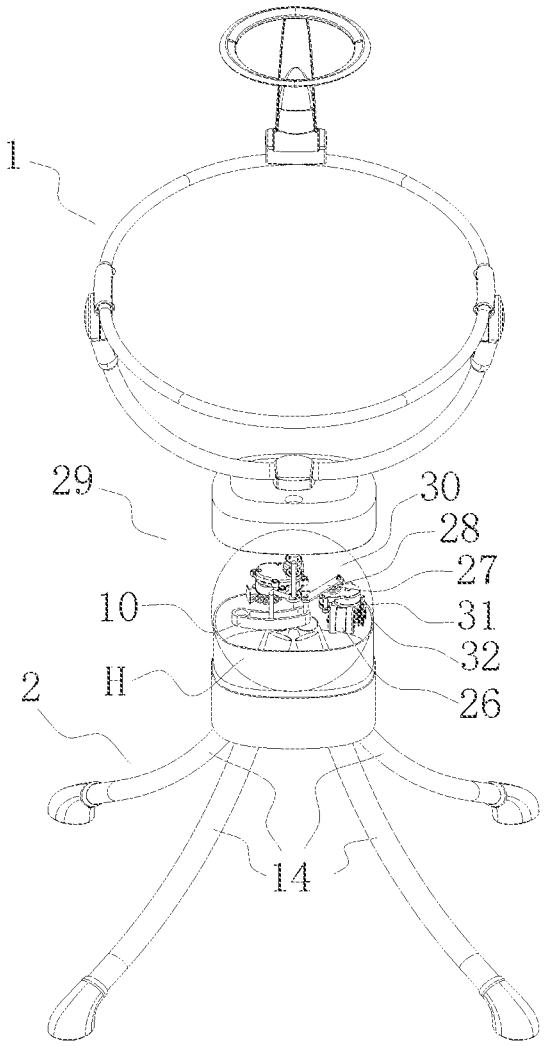
FIG. 11 is a structural diagram of a rocking chair for children with electric mode conversion.
Figure 12:
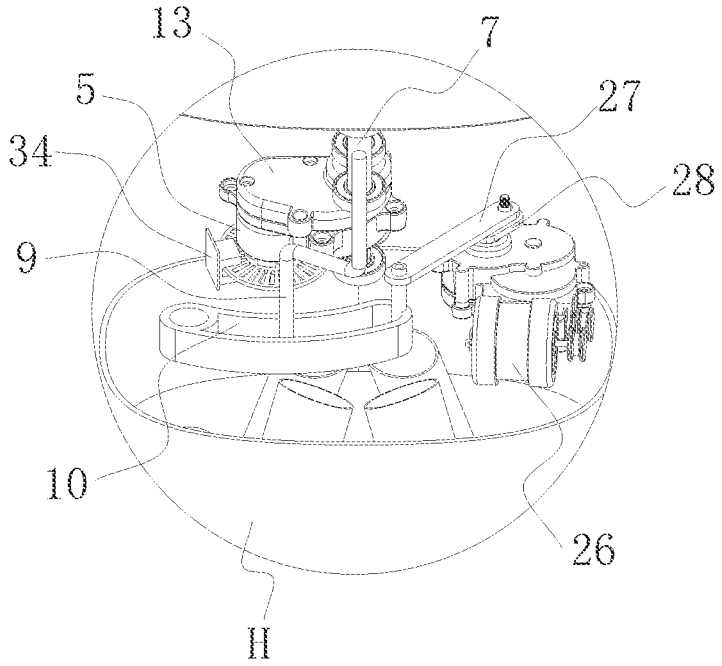
FIG. 12 is an enlarged schematic diagram at H of FIG. 11.
Figure 13:
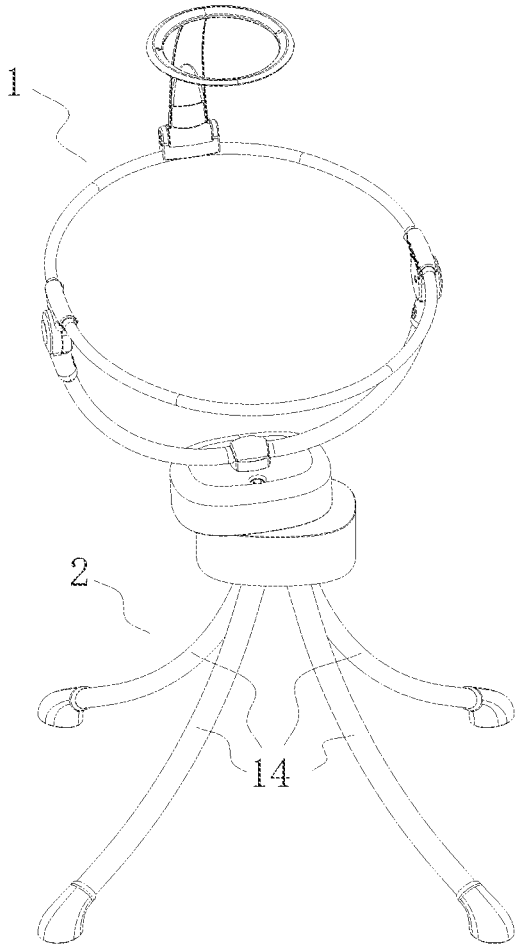
FIG. 13 is a schematic diagram of the state of one of the multiple swing modes of a rocking chair for children.
Figure 14:
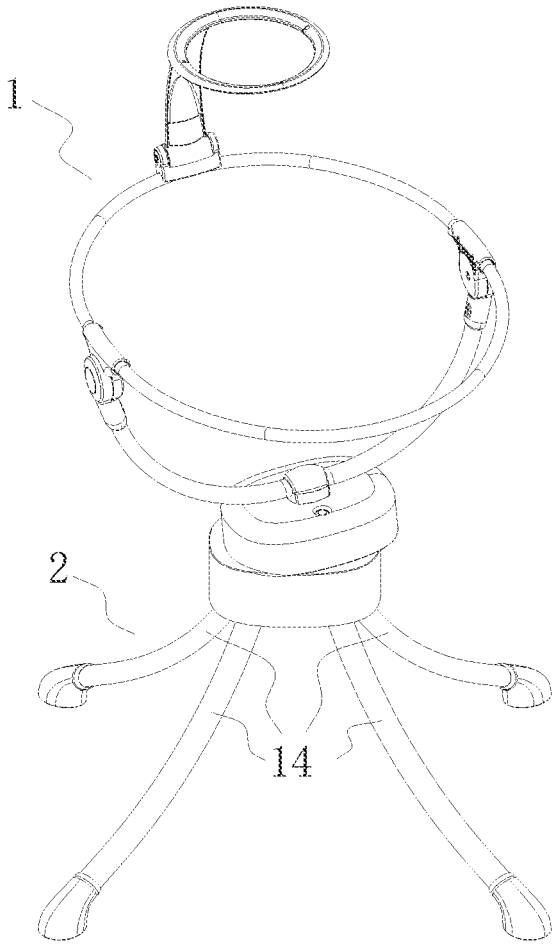
FIG. 14 is a schematic diagram of the state of another swing mode of the multiple swing modes of a rocking chair for children.
Figure 15:
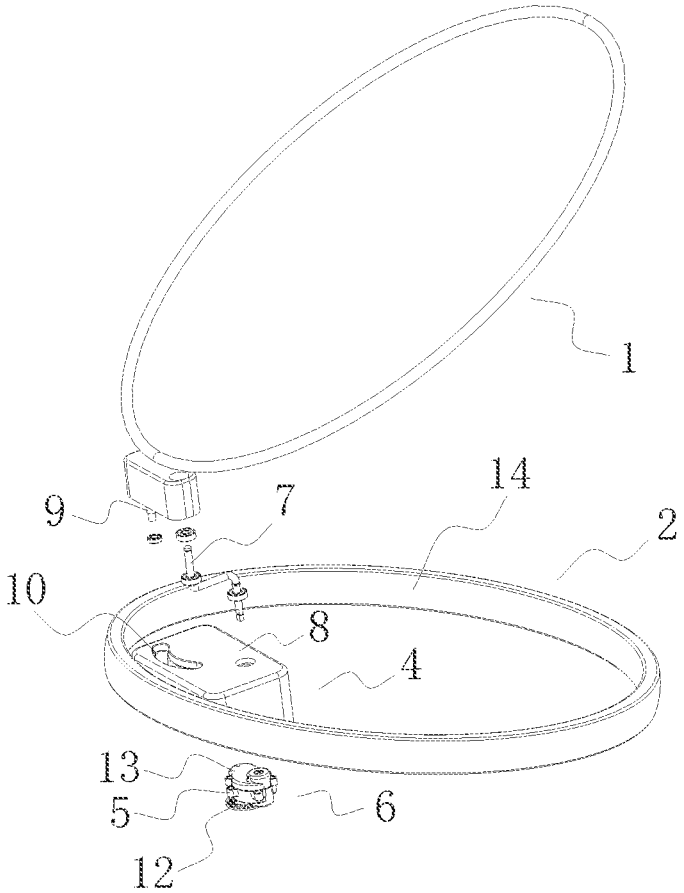
FIG. 15 is a structural diagram of a rocking chair for children.
Figure 16:
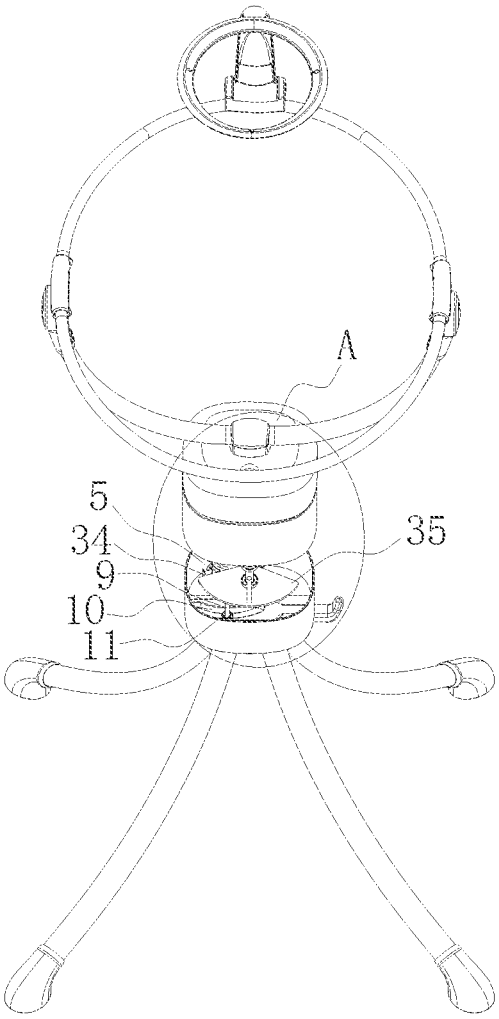
FIG. 16 is a structural diagram of a rocking chair for children with swing mode conversion.
Figure 17:
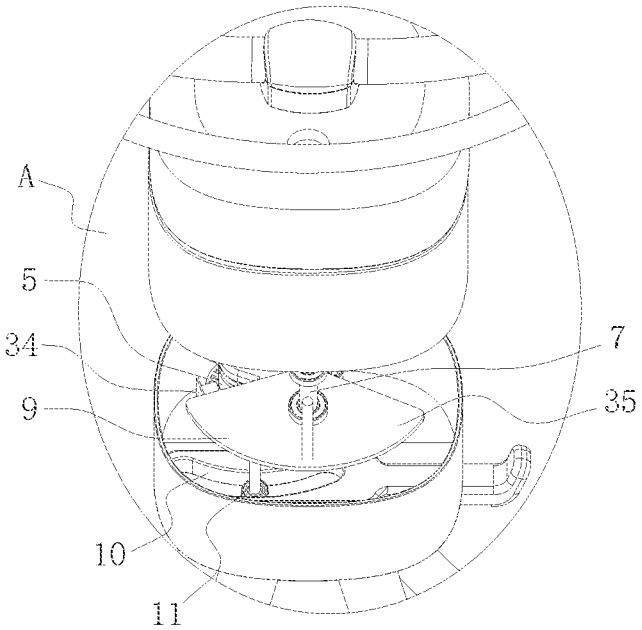
FIG. 17 is an enlarged schematic diagram at A of FIG. 16.
Figure 18:
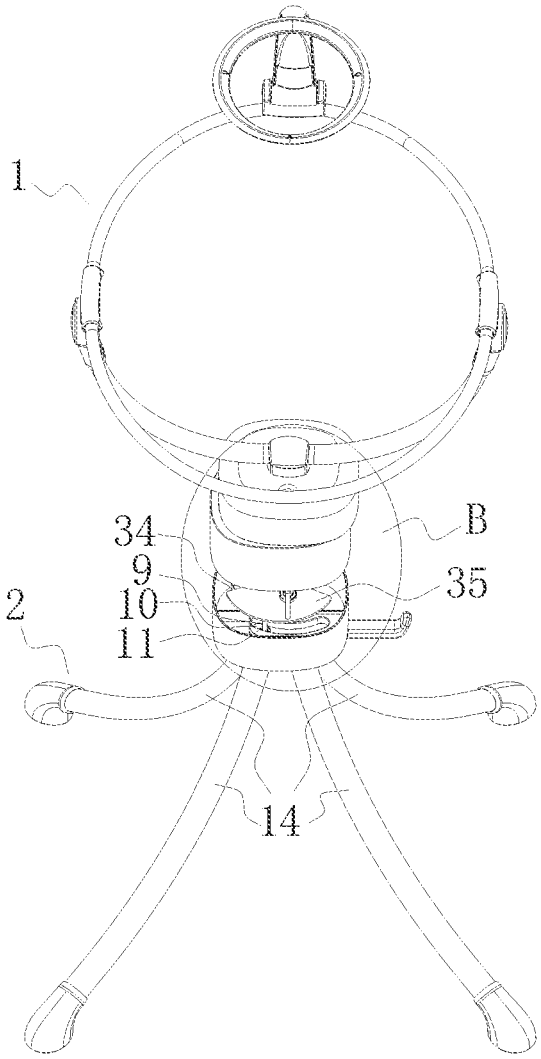
FIG. 18 is the structural diagram of a rocking chair for children after swing mode conversion in FIG. 16.
Figure 19:
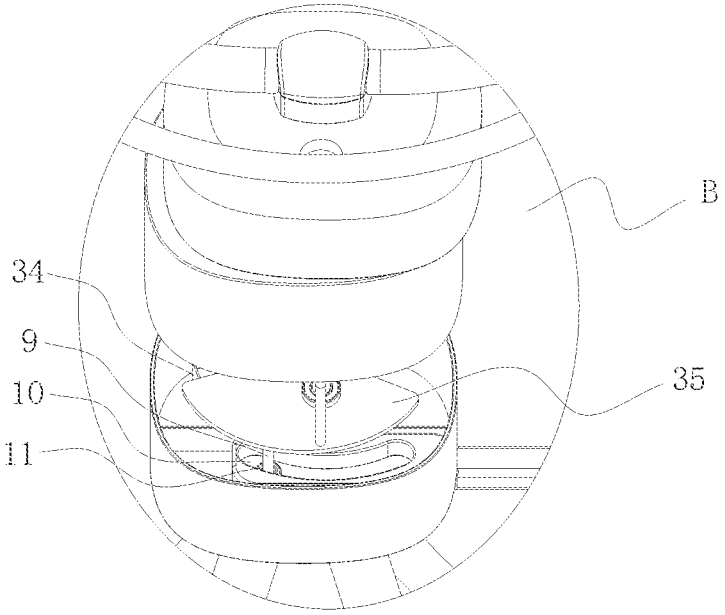
FIG. 19 is an enlarged schematic diagram at B of FIG. 18.

The embodiments of the invention are now described with reference to FIG. 1-FIG. 19.

A rocking chair for children is characterized by including a seat body 1, a supporting frame 2 and a seat body limiting mechanism 3; the supporting frame 2 includes a base 14 and a driving mechanism 4, the driving mechanism 4 includes a driving electric motor 5, a driving electric motor power output portion 6, a rotating shaft 7, and a mounting box 8, one end of the rotating shaft 7 is fixedly connected with the driving electric motor power output portion 6, and the seat body 1 pivots around the other end of the rotating shaft 7, when the rotating shaft 7 rotates, a pivot point between the other end of the rotating shaft 7 and the seat body 1 moves relative to a fixed connection point between one end of the rotating shaft 7 and the driving electric motor power output portion 6 at a certain distance; the driving electric motor 5 and the driving electric motor power output portion 6 are arranged on the mounting box 8, the mounting box 8 is fixedly connected with the base 14, and the seat body limiting mechanism 3 includes a driving piece 9 and a driving matching piece 10; and when the rotating shaft 7 rotates, a matching point of the driving piece 9 and the driving matching piece 10 moves relative to the supporting frame 2 at a certain distance, the seat body limiting mechanism 3 limits the included angle between the seat body 1 and the rotating shaft 7 to be maintained at a set angle when the driving electric motor 5 drives the rotating shaft 7; and the seat body 1 is used for carrying a child.

In order to bring more entertainment to consumers, the seat body limiting mechanism 3 of the rocking chair for children further includes a swing mode conversion portion 29, which can realize conversion of at least two swing modes.

The swing mode conversion portion 29 includes a driving portion 30, and the driving portion 30 drives the driving piece 9 to match with the driving matching piece 10, and the generated matching point forms at least two different motion trajectory lines, so as to realize the conversion of at least two swing modes.

The driving portion 30 includes an electric driving portion 31, the driving piece 9 rotates or moves relative to the driving matching piece 10 at a certain distance, and the driving matching piece 10 rotates or moves relative to the supporting frame 2 at a certain distance, and when the rotating shaft 7 rotates, the driving portion 30 drives the driving matching piece 10 to rotate or move relative to the supporting frame 2 at a certain distance, so as to realize the conversion of at least two swing modes. The setting of the electric driving portion 31 can realize the automatic conversion of at least two modes without manual operation, which is intelligent and more popular with consumers.

The driving piece 9 is a moving piece 9, the driving matching piece 10 is a moving groove, and the moving groove is pivoted with the supporting frame 2; the electric driving portion 30 includes a driving electric motor group 32 which includes a motor 26, a rotating piece 28 and an output piece 27, the motor 26 is fixedly connected with the rotating piece 28, the rotating piece 28 is pivoted with the output piece 27, and the output piece 27 is pivoted with the moving groove, the rotating shaft 7 rotates the driving electric motor group 32 to enable the moving groove to continuously rotate back and forth relative to the supporting frame 2. Each swing mode can be determined by the rotation angle between the driving matching piece 10 and the supporting frame 2 or the length of the movement distance, or the speed at which the driving portion 30 drives the swing mode conversion portion 29 to rotate or move relative to the supporting frame 2 at a certain distance. The above determinants can be controlled by a circuit control board as long as a variety of swing modes are set and how to convert among a variety of swing modes is intelligently controlled by the circuit control board, the tedious manual operation required for each swing mode conversion is greatly reduced, and the defects of high cost of mechanical conversion and few types of mechanical conversion swing modes are overcome. The operation is convenient and the entertainment of consumers is enriched.

The driving portion includes a locking and unlocking piece, the driving piece 9 moves relative to the driving matching piece 10 at a certain distance, and the driving matching piece 10 rotates or moves relative to the supporting frame 2 at a certain distance; and after the driving matching piece 10 and the supporting frame 2 are unlocked and the driving matching piece 10 rotates or moves relative to the supporting frame 2 at a certain distance, the driving matching piece 10 and the supporting frame 2 are locked, and the driving matching piece 10 cooperates with the driving piece 9 to form another swing mode.

The driving piece 9 is a moving piece 9, the driving matching piece 10 is a moving groove, the moving groove includes at least two moving grooves, the first moving groove 16 and the second moving groove 17, notches of the first moving groove 16 and the second moving groove 17 do not coincide, and the moving groove moves up and down relative to the supporting frame 2. When the first moving groove 16 is matched with the first moving piece 18, it is the first swing mode, and when the second moving groove 17 is matched with the second moving piece 19, it is the second swing mode. When the moving groove moves up and down relative to the supporting frame 2, the first moving groove 16 and the second moving groove 17 cooperate alternately relative to the moving piece 9, so as to achieve the conversion of two swing modes. It has the advantages of simple structure, convenient operation and low cost.

The driving piece 9 is a moving piece 9, the driving matching piece 10 is a moving groove, and the moving groove moves relative to the supporting frame 2 along the swing direction of the rotating shaft 7. The moving groove moves relative to the supporting frame 2 to change the cooperation between the moving groove and the moving piece 9 to form different swing modes. The operation is convenient and the structure is simple.

The moving piece 9 includes at least two moving pieces, namely, a third moving piece 22 and a fourth moving piece 23, the moving groove includes at least two moving grooves, namely, a third moving groove 20 and a fourth moving groove 21, the third moving piece 22 is matched with the third moving groove 20, and the fourth moving piece 23 is matched with the fourth moving groove 21, one moving grooves is provided with a move-out opening groove for the corresponding moving piece to move out, the other moving groove is provided with a move-in opening groove for the corresponding moving piece to move in, the width of the move-out opening groove and the move-in opening groove is larger than the moving groove. Setting two moving pieces and two moving grooves can overcome the disadvantage that the arc generated by one moving piece and one moving groove is relatively curved when the required rotation mode is required, resulting in unsmooth swing. When the third moving piece 22 is matched with the third moving groove 20, the fourth moving piece 23 is not matched with the fourth moving groove 21, resulting in no interference, and when the third moving piece 22 is moved out of the third moving groove 20, the fourth moving piece 23 is matched with the fourth moving groove 21, so that through different settings of the third moving groove 20, it not only enriches a variety of swing modes, but also does not cause unsmooth swing. The notches of the third moving groove 20 and the fourth moving groove 21 do not coincide, that is, the third moving groove 20 and the fourth moving groove 21 are set, so as to enrich a variety of different swing modes.

A stop 33 is arranged on the moving groove, a rotating piece 24 is arranged on the moving piece 9, when one side of the seat body 1 is under gravity, the moving piece 9 will move to the top, and the rotating piece 25 is limited by the stop 33, so that the seat body will not tilt when under gravity, so as to ensure the safety of consumers.

The moving piece 9 is arranged on the seat body 1, and the moving groove is arranged on the supporting frame 2. A more reasonable structural setting is chosen, of course, the moving piece 9 can also be arranged on the supporting frame 2, and the moving groove can be arranged on the seat body 1.

The moving groove is an arc groove or a wave-shaped groove with alternating heights. The moving groove can have a variety of shapes. The shape of the moving groove determines the included angle relationship between the seat body 1 and the rotating shaft 7. Many shapes can be selected according to needs. For example, the moving groove is an arc groove, the rotating shaft 7 rotates, the seat body 1 moves at a certain distance with the rotating shaft 7, and the seat body 1 always keeps the included angle between the seat body 1 and the rotating shaft 7 unchanged, therefore, it is only the preferred solution that the moving groove is an arc groove or a wave-shaped groove with alternating heights.

A rotating piece 25 is arranged on the moving piece 9, the rotating piece 25 is able to rotate around the moving piece 9, and the rotating piece 25 is in surface fit with the moving groove. Through the rotating piece 25, the friction is reduced when the moving piece 9 moves with the moving groove. The rotating piece 25 of the present embodiment is a bearing.

The driving mechanism 4 further includes a sensor 34 arranged on the driving electric motor 5 and a reduction gear set 13 connected with the driving electric motor 5, the sensor 34 is able to control the driving electric motor 5 to continuously rotate forwards and backwards in a reciprocating mode so that the rotating shaft 7 is able to continuously rotate forwards and backwards in a reciprocating mode. The sensor 34 detects the rotation angle of the rotating shaft 7 and the forward and reverse rotation of the driving electric motor 5, controls the moving distance of the seat body 1, and reduces the speed and increases the force through the reduction gear set 13. The structure is simple and the cost is low. The rotating shaft 7 is obliquely arranged to realize the conversion of kinetic energy and potential energy so as to save labor.

The rocking chair for children also includes a driving mounting box 15, the moving piece 9 includes an upper end and a lower end, the upper end is fixedly connected or integrally formed with the lower end, the upper end is connected with the seat body 1 after passing through the driving mounting box 15, the lower end is matched with the moving groove, and a connection point between the upper end and the seat body 1 deviates from a matching point between the lower end and the moving groove. The upper end of the moving piece 9 and a slotted hole passing through the driving mounting box 15 are in the middle of the driving mounting box 15, which reduces the cost of covering the slotted hole and reduces the volume at the same time. The matching point deviates from the connection point, resulting in a moment of force, so that the swing is not smooth.

The mounting box 8 is provided with a slotted hole sheet 35, the slotted hole sheet 35 is movably arranged with the mounting box 8, and the slotted hole sheet 35 is also provided with a slotted hole for the moving piece 9 to move, and when the moving piece 9 moves, the moving piece 9 drives the slotted hole sheet 35 to block the slotted hole. The moving piece 9 drives the slotted hole sheet 35 to rotate around the mounting box 8, and the rotating shaft 7 moves up and down in the slotted hole of the slotted hole sheet 35, so as to realize the arc shape of the slotted hole sheet 35, so that the slotted hole sheet 35 can cover the moving slotted hole and has a small volume, so that the mounting box 8 can be small without clamping hands, so as to become beautiful and save costs.

The rocking chair for children of the invention has the advantages of large swing range, low cost, stable seat body and simple structure. At the same time, it can be set into two or more different swing modes, which overcomes the disadvantages of small swing range, high process requirements and single swing mode in the market. The invention has the advantages of simple structure, low cost and stable rocking chair seat body 1. It can realize two different swing modes at the same time and set the conversion of multiple swing modes, and is invented by engineers after long-term and careful research, so that it is not easy for those in the art to think of and does not belong to the public common sense. One end and the other end described in the invention are only distinguished by the names of describing things, and can be understood as the top of something or a section of something.

Although the invention has been described above with reference to embodiments, various improvements can be made without departing from the scope of the invention, and the invention can be implemented in equivalent or other ways well known to those skilled in the art. In particular, as long as there is no structural conflict, the features in the embodiments disclosed in the invention can be combined with each other in any way. The description does not describe these combinations exhaustively, just for the sake of omitting space and saving resources. Therefore, the invention is not limited to the specific embodiments disclosed herein, but includes all technical solutions falling within the scope of the claims. The first, second, third and fourth described in this invention are only to distinguish the names of things, and have no actual data significance.

The invention claimed is:

1. A rocking chair for children, characterized by comprising a seat body, a supporting frame and a seat body limiting mechanism;

wherein the supporting frame comprises a base and a driving mechanism, the driving mechanism comprises a driving electric motor, a driving electric motor power output portion and a rotating shaft, one end of the rotating shaft is fixedly connected with the driving electric motor power output portion, and the seat body pivots around another end of the rotating shaft, when the rotating shaft rotates, a pivot point between the other end of the rotating shaft and the seat body moves relative to a fixed connection point between one end of the rotating shaft and the driving electric motor power output portion at a certain distance;

both of the driving electric motor and the driving electric motor power output portion are arranged on the base, and the seat body limiting mechanism comprises a driving piece, a driving matching piece and a swing mode conversion portion; and when the driving electric motor drives the rotating shaft, the swing mode conversion portion enables a matching point of the driving piece and the driving matching piece to move relative to the supporting frame at a certain distance, so as to limit an included angle between the seat body and the rotating shaft to be maintained at a set angle; and the swing mode conversion portion is able to realize conversion of at least two swing modes by matching the driving piece with the driving matching piece.

2. The rocking chair for children according to claim 1, characterized in that the swing mode conversion portion comprises a driving portion, and the driving portion drives the driving piece to match with the driving matching piece, so that a matching point forms at least two different motion trajectory lines, so as to realize the conversion of the at least two swing modes.

3. The rocking chair for children according to claim 2, characterized in that the driving portion comprises an electric driving portion, the driving piece rotates or moves relative to the driving matching piece at a certain distance, and the driving matching piece rotates or moves relative to the supporting frame at a certain distance, and when the rotating shaft rotates, the driving portion drives the driving matching piece to rotate or move relative to the supporting frame at a certain distance, so as to realize the conversion of at least two swing modes.

4. The rocking chair for children according to claim 3, characterized in that the driving piece is a moving piece, the driving matching piece is a moving groove, and the moving groove is pivoted with the supporting frame; and the electric driving portion comprises a driving electric motor group which comprises a motor, a rotating piece and an output piece, the motor is fixedly connected with the rotating piece, the rotating piece is pivoted with the output piece, and the output piece is pivoted with the moving groove, the rotating shaft rotates the driving electric motor group to enable the moving groove to continuously rotate back and forth relative to the supporting frame.

5. The rocking chair for children according to claim 4, characterized in that the driving portion further comprises a locking and unlocking piece, the driving piece moves relative to the driving matching piece at a certain distance, and the driving matching piece rotates or moves relative to the supporting frame at a certain distance; and after the driving matching piece and the supporting frame are unlocked and the driving matching piece rotates or moves relative to the supporting frame at a certain distance, the driving matching piece and the supporting frame are locked, and the driving matching piece cooperates with the driving piece to form another swing mode.

6. The rocking chair for children according to claim 5, characterized in that the driving piece is a moving piece, the driving matching piece is a moving groove, the moving groove comprises at least two moving grooves, a first moving groove and a second moving groove, notches of the first moving groove and the second moving groove do not coincide, and the moving groove moves up and down relative to the supporting frame.

7. The rocking chair for children according to claim 6, characterized in that the moving piece pivots around the moving groove, the moving piece is provided with a first rotating piece and a second rotating piece, the first rotating piece is matched with the first moving groove, and the second rotating piece is matched with the second moving groove.

8. The rocking chair for children according to claim 5, characterized in that the driving piece is a moving piece, the driving matching piece is a moving groove, and the moving groove moves relative to the supporting frame along a swing direction of the rotating shaft.

9. The rocking chair for children according to claim 1, characterized in that the driving piece is a moving piece, and the driving matching piece is a moving groove; and the moving piece comprises at least two moving pieces, namely, a third moving piece and a fourth moving piece, the moving groove comprises at least two moving grooves, namely, a third moving groove and a fourth moving groove, the third moving piece is matched with the third moving groove, and the fourth moving piece is matched with the fourth moving groove, one moving grooves is provided with a move-out opening groove for a corresponding moving piece to move out, another moving groove is provided with a move-in opening groove for the corresponding moving piece to move in, a width of the move-out opening groove and the move-in opening groove is larger than the moving groove, and notches of the third moving groove and the fourth moving groove do not coincide.

10. The rocking chair for children according to claim 9, characterized in that a stop is arranged on the moving groove, a rotating piece is arranged on the moving piece, and a bearing is pivoted on the rotating piece; when the moving piece moves to a top of the moving groove, the stop restricts a rotation of the rotating piece.

11. The rocking chair for children according to claim 10, characterized in that the moving piece is arranged on the seat body, and the moving groove is arranged on the supporting frame; or the moving piece is arranged on the supporting frame, and the moving groove is arranged on the seat body.

12. The rocking chair for children according to claim 11, characterized in that the moving groove is an arc groove or a wave-shaped groove with alternating heights.

13. The rocking chair for children according to claim 12, characterized in that a rotating piece is arranged on the moving piece, the rotating piece is able to rotate around the moving piece, and the rotating piece is in surface fit with the moving groove.

14. The rocking chair for children according to claim 13, characterized in that the rocking chair for children also comprises a mounting box arranged on the base, the driving piece comprises an upper end and a lower end, the upper end is fixedly connected or integrally formed with the lower end, the upper end is connected with the seat body after passing through the mounting box, the lower end is matched with the driving matching piece, and a connection point between the upper end and the seat body deviates from a matching point between the lower end and the moving groove.

15. The rocking chair for children according to claim 14, characterized in that the mounting box is provided with a slotted hole sheet, the slotted hole sheet is movably arranged with the mounting box, and the slotted hole sheet is also provided with a slotted hole for the moving piece to move, and when the moving piece moves, the moving piece drives the slotted hole sheet to block the slotted hole.

16. The rocking chair for children according to claim 1, characterized in that the driving mechanism further comprises a sensor arranged on the driving electric motor, the sensor is able to control the driving electric motor to continuously rotate forwards and backwards in a reciprocating mode so that the rotating shaft is able to continuously rotate forwards and backwards in a reciprocating mode, and the rotating shaft is obliquely arranged.

17. The rocking chair for children according to claim 1, characterized in that the driving mechanism further comprises a reduction gear set connected with the driving electric motor to realize speed reduction and force increase of the seat body.

* * * * *